US006922960B2

(12) United States Patent
Sataka

(10) Patent No.: US 6,922,960 B2
(45) Date of Patent: Aug. 2, 2005

(54) MULTIPLE DWELLING HOUSE

(75) Inventor: Keizo Sataka, Tokyo (JP)

(73) Assignees: Institute of International Environment, Tokyo (JP); Renaizm Ltd., Tokyo (JP)

( * ) Notice: Subject to any disclaimer, the term of this patent is extended or adjusted under 35 U.S.C. 154(b) by 0 days.

(21) Appl. No.: 10/176,340

(22) Filed: Jun. 20, 2002

(65) Prior Publication Data

US 2003/0005653 A1 Jan. 9, 2003

(30) Foreign Application Priority Data

Jul. 3, 2001 (JP) ..... 2001-202299

(51) Int. Cl.[7] ..... E04H 1/00; E04H 14/00; E04H 3/00; E04H 5/00; E04H 6/00

(52) U.S. Cl. ..... 52/236.3; 52/236.4; 52/236.5; 52/185

(58) Field of Search ..... 52/236.3, 236.4, 52/236.5, 185

(56) References Cited

U.S. PATENT DOCUMENTS 383,170 A * 5/1888 Buffington ..... 52/236.3
3,330,083 A * 7/1967 Jaulmes ..... 52/174
5,809,704 A * 9/1998 Stewart et al. ..... 52/169.4
6,155,012 A * 12/2000 Halbitte ..... 52/236.3
6,405,496 B1 * 6/2002 Stewart et al. ..... 52/185

FOREIGN PATENT DOCUMENTS

JP 50140993 * 6/1993 ..... 52/236.3
JP 405179710 * 7/1993 ..... 52/23.3
JP 09-137613 5/1997

* cited by examiner

*Primary Examiner*—Carl D. Friedman
*Assistant Examiner*—Nahid Amiri
(74) *Attorney, Agent, or Firm*—Flynn, Thiel, Boutell & Tanis, P.C.

(57) ABSTRACT

The invention provides a multiple dwelling house in which although its standard floors are constructed to have the same structural floor height, the ceiling heights of individual dwelling units positioned above and below each flat slab can be set to differ from each other so that the multiple dwelling house has ceiling heights capable of meeting a variety of needs of users. The multiple dwelling house includes standard floors constructed to have the same structural floor height dimension, intermediate slabs each of which is made of a flat slab and is disposed between each of adjacent upper and lower floors, and slabs each of which is made of a beam slab and forms a ceiling face of the upper floor and a floor face of the lower floor. One unit made of the adjacent upper and lower floors is constructed in a sequentially repeated manner to make dwelling-unit spaces different in ceiling height between the adjacent upper and lower floors.

11 Claims, 9 Drawing Sheets

MULTIPLE DWELLING HOUSE

BACKGROUND OF THE INVENTION

1. Field of the Invention

The present invention generally relates to comparatively low-rise buildings as well as medium- or high-rise buildings, and more particularly, to a multiple dwelling house in which its standard floors have the same structural floor height, wherein individual dwelling-unit spaces constructed on its respective standard floors are set to differ in structural ceiling height between adjacent upper and lower floors so as to meet a variety of needs of users.

2. Background Art

Related-art buildings such as multiple dwelling houses, office buildings or buildings used for both dwelling and office purposes (these houses and building will be hereinafter referred to generally as multiple dwelling houses) include standard floors each having the same slab-to-slab dimension. Accordingly, each of the dwelling units of such a multiple dwelling house has the same dimensions, and the ceiling height of each of the dwelling units is also set to the same dimension.

If a variation is to be given to the ceiling height of each of the dwelling units, it has been common practice to form an appropriate space between its slab and its ceiling face or between the slab and its floor face.

Accordingly, there has not yet been an idea which aims to positively realize a multiple dwelling house securing a ceiling height effectively while having different ceiling heights capable of meeting a variety of needs of users.

On the other hand, an example in which floor structural beams are formed into a flat slab structure is known as one structural form of the multiple dwelling house. The flat slab method is a method of constructing beams on the upper surface of a slab, and the reasons for which the flat slab method is adopted are mainly as follows: as shown in the related-art example of FIG. 9, the upper surfaces of beams are made flush with the layout surface of a finished floor A and a space B which is formed between each slab and the floor face of the finished floor A can be used as an underfloor storage space or a piping or wiring space for various kinds of equipment; or since beams which project downward do not exist on any ceiling face C, no stepped ceilings made of partly lowered ceilings are formed but flat ceilings can be formed during a slab constructing process.

Furthermore, during the construction of a building, the flat slab method is applied to only predetermined floors or to the entire multiple dwelling house. Accordingly, the related art does not have an idea which aims to provide a relative relationship between flat slabs and beam slabs in the way of alternately disposing slabs formed by a flat slab method and slabs formed by a beam slab method.

SUMMARY OF THE INVENTION

The invention provides a multiple dwelling house in which although its standard floors are constructed to have the same structural floor height, the ceiling heights of individual dwelling units positioned above and below each flat slab can be set to differ from each other so that the multiple dwelling house has ceiling heights capable of meeting a variety of needs of users.

In addition, since each intermediate slab disposed between adjacent upper and lower floors is a flat slab, a dwelling-unit space positioned below the slab is lower in ceiling height dimension than a dwelling-unit space positioned above the slab. However, a structural floor height (defined herein as the distance between the upper surfaces of adjacent upper and lower beams) can be ensured by a predetermined amount, and each of a ceiling face and a floor face becomes a flat face so that a space defined between upper and lower faces having no unevenness can be obtained and hence a wide space can be obtained, whereby it is possible to ensure an effective ceiling height dimension.

On the other hand, in the dwelling-unit space positioned above the slab, its floor face is positioned below its flat slab, whereby it is possible to realize a dwelling-unit space having a large ceiling height dimension by forming the face of the flat slab as a finished floor face.

As described above, it is possible to increase the ceiling height dimension of either of the upper and lower floors, whereby it is possible to form a rich three-dimensional space marked by variety.

In one form of variety, each dwelling unit is constructed of a plurality of stories to increase the required floor area, and at the same time, its storage space is constructed in a structural form which is excluded from the floor area of the dwelling unit, whereby it is possible to form an effective three-dimensional space.

The term "story" used herein denotes one of different spaces which are formed above and below a floor slab when a dwelling-unit space disposed at a structural floor height is separated by a floor slab (independent of whether the area of the floor slab is to be added to the floor area of the dwelling-unit space).

The invention solves the problems of the above-described related art and provides the following constructions.

A multiple dwelling house includes: standard floors constructed to have the same structural floor height dimension; intermediate slabs each of which is made of a flat slab and is disposed between each of adjacent upper and lower floors; and slabs each of which is made of a beam slab and forms a ceiling face of the lower floor and a floor face of the upper floor. One unit made of the adjacent upper and lower floors is constructed in a sequentially repeated manner to make dwelling-unit spaces different in ceiling height between the adjacent upper and lower floors.

In addition, in the multiple dwelling house, each of the slab has an upper surface formed as a finished floor face.

Further, in the multiple dwelling house, each dwelling unit is, in part or in whole, made of two stories or three stories, and a stuff storage space is provided in any one or ones of the stories.

In addition, in the multiple dwelling house, the stuff storage space is in part formed as an ecological space.

Furthermore, in the multiple dwelling house, either one of the adjacent upper and lower floors is formed as a wellhole-style space through which wind can blow.

BRIEF DESCRIPTION OF THE DRAWINGS

The invention will become more readily appreciated and understood from the following detailed description of preferred embodiments of the invention when taken in conjunction with the accompanying drawings, in which.

DETAILED DESCRIPTION OF THE INVENTION

Preferred embodiments of the invention will be described below in detail with reference to the accompanying drawings.

A first embodiment of the invention will be described below.

Figure 1:
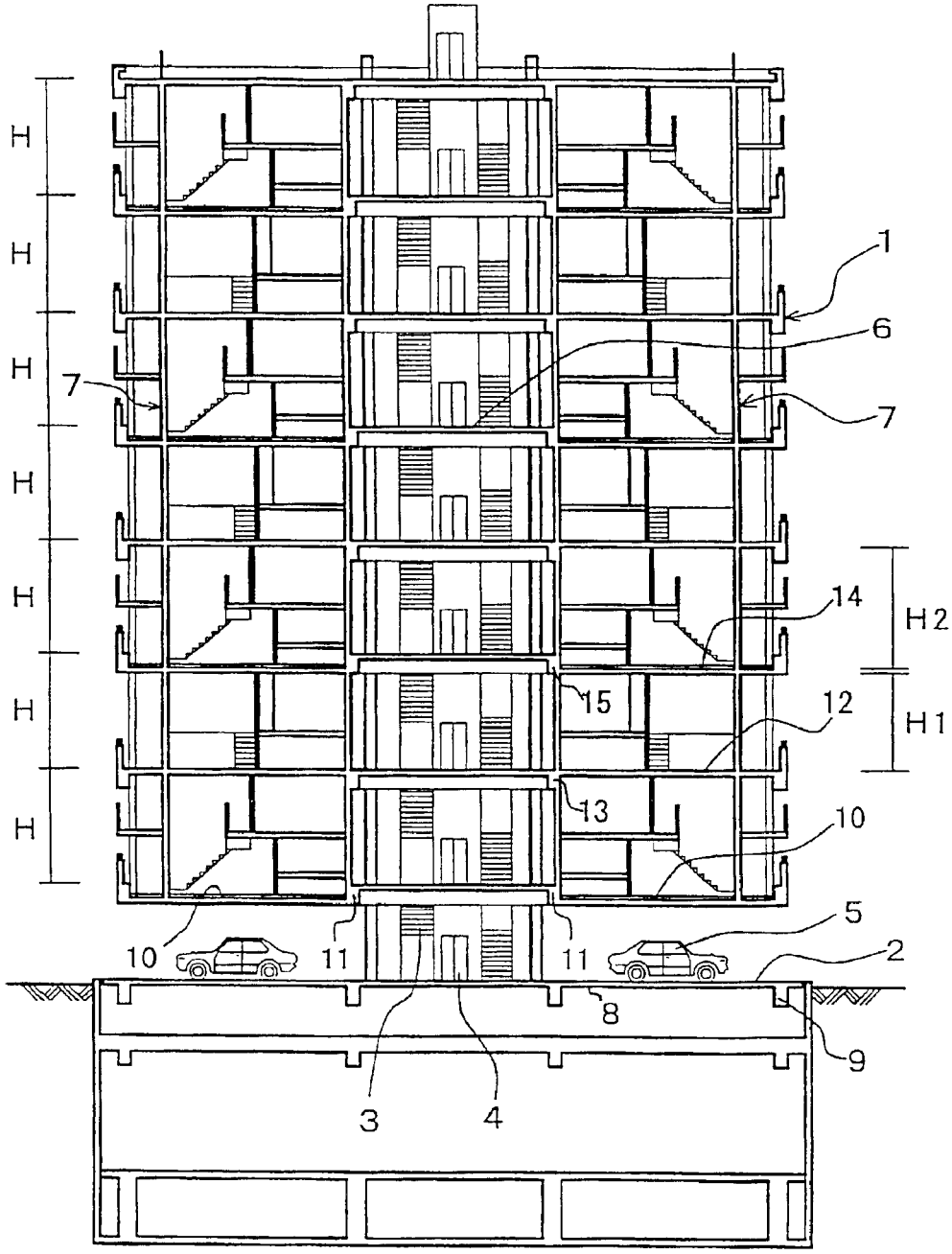
FIG. 1 is a cross-sectional view showing the first embodiment of the multiple dwelling house according to the invention.

FIG. 1 is a cross-sectional view showing a medium-rise multiple dwelling house.

The multiple dwelling house according to the first embodiment is a multiple dwelling house 1 having eight floors above ground level and one floor below ground level. The first floors above and below ground level have an entrance hall, a parking area and a space associated therewith, and standard floors which include the second to eighth floors have dwelling units.

The parking area on the first floor below ground level includes a mechanical two-storied car parking system, and the first floor above ground level includes an entrance hall 2 which is an approach to the upper floors, stairs 3, an elevator 4, a turntable space for the parking area on the first floor below ground level, and a parking area 5.

Each of the standard floors includes the stairs 3, the elevator 4 and a common space 6 which includes a hall disposed in front of the elevator 4 as well as a passage. Dwelling units 7 are disposed symmetrically about the common space 6.

In the structural planning of the multiple dwelling house 1, each of the standard floors except the first floors above and below ground level is assigned a constant structural floor height H in terms of economical efficiency and external appearance.

A floor slab 8 of the first floor and each underground beam 9 are constructed into a T-beam by a beam slab method, and the finished surface of the floor slab 8 and the finished upper surfaces of the underground beams 9 are made flush with one another. A floor slab 10 for dwelling units on the second floor and each beam 11 of the first floor are constructed by a flat slab method so that the lower surface of the floor slab 10 and the lower surfaces of the beams 11 of the first floor are flush with one another.

A floor slab 12 which constitutes dwelling units on the third floor and each beam 13 of the second floor are constructed by a beam slab method so that the finished surface of the floor slab 12 and the finished upper surfaces of the beams 13 are made flush with one another. A floor slab 14 for dwelling units on the fourth floor and each beam 15 of the third floor are constructed by a flat slab method.

As described above, in the multiple dwelling house 1, its beam slabs and its flat slabs are alternately constructed. Accordingly, even if the structural floor height H between the upper surfaces of the beams of each of the standard floors and those of the beams of the next adjacent one has the same dimension, for example, a slab-to-slab dimension H1 of the third floor differs form a slab-to-slab dimension H2 of the fourth floor.

In the first embodiment, the structural floor height H of each of the standard floors is made the same dimension, and the floor slab surface of each of the even-numbered floors is constructed as a floor face based on a flat slab method so that the slab-to-slab dimension H2 of each of the even-numbered floors can be made large, whereas the floor slab surface of each of the odd-numbered floors is constructed as a floor face based on a beam slab method so that the slab-to-slab dimension of each of the odd-numbered floors can be made smaller than the slab-to-slab dimension of each of the even-numbered floors.

One embodiment of floor planning for the standard floors will be described below. In the following description, reference to the even-numbered floors and reference to the odd-numbered floors will be separately made.

Figure 2:
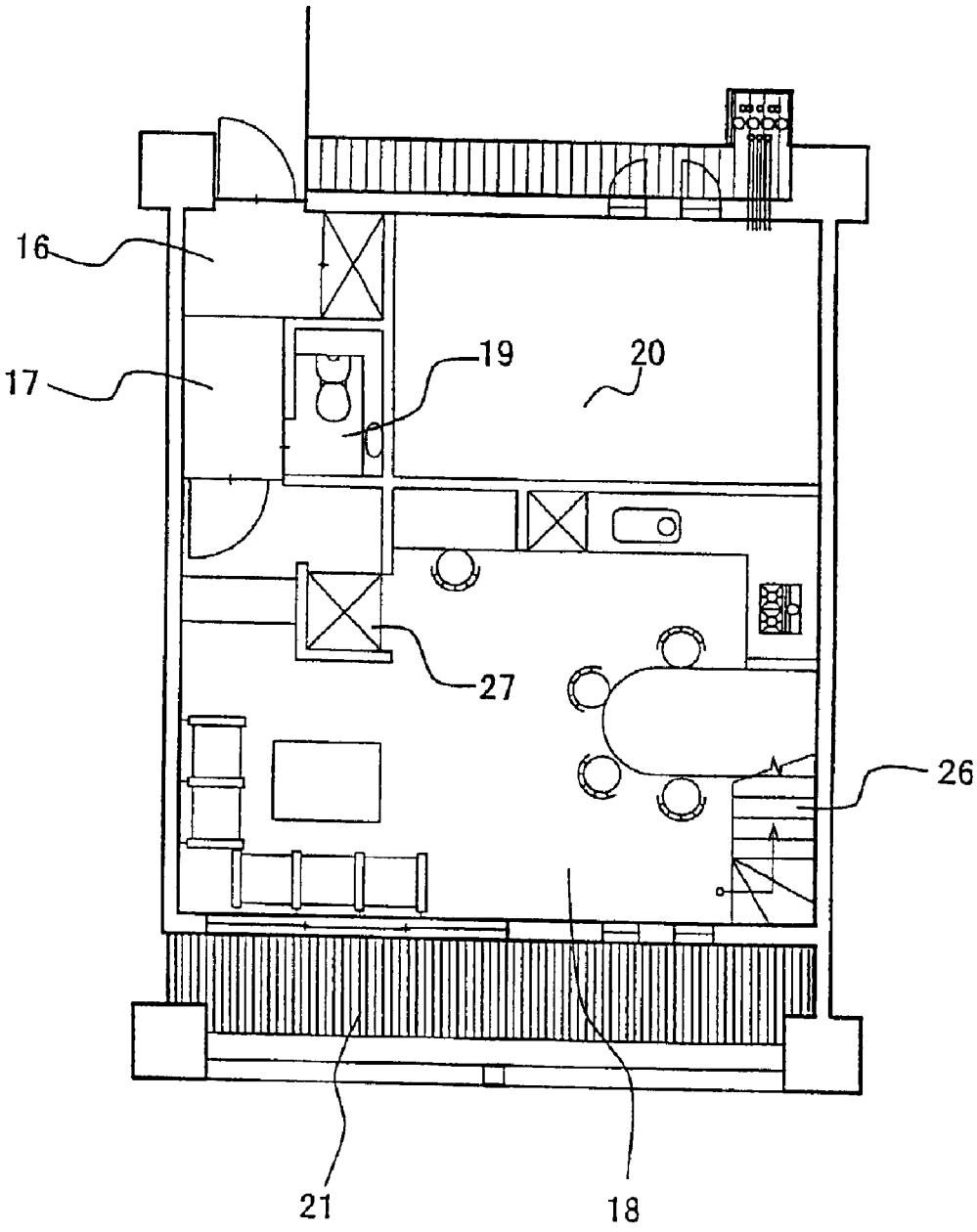
FIG. 2 is a plan view of a reference floor part of a standard floor which constitutes one example of the first embodiment of the multiple dwelling house according to the invention.
Figure 3:
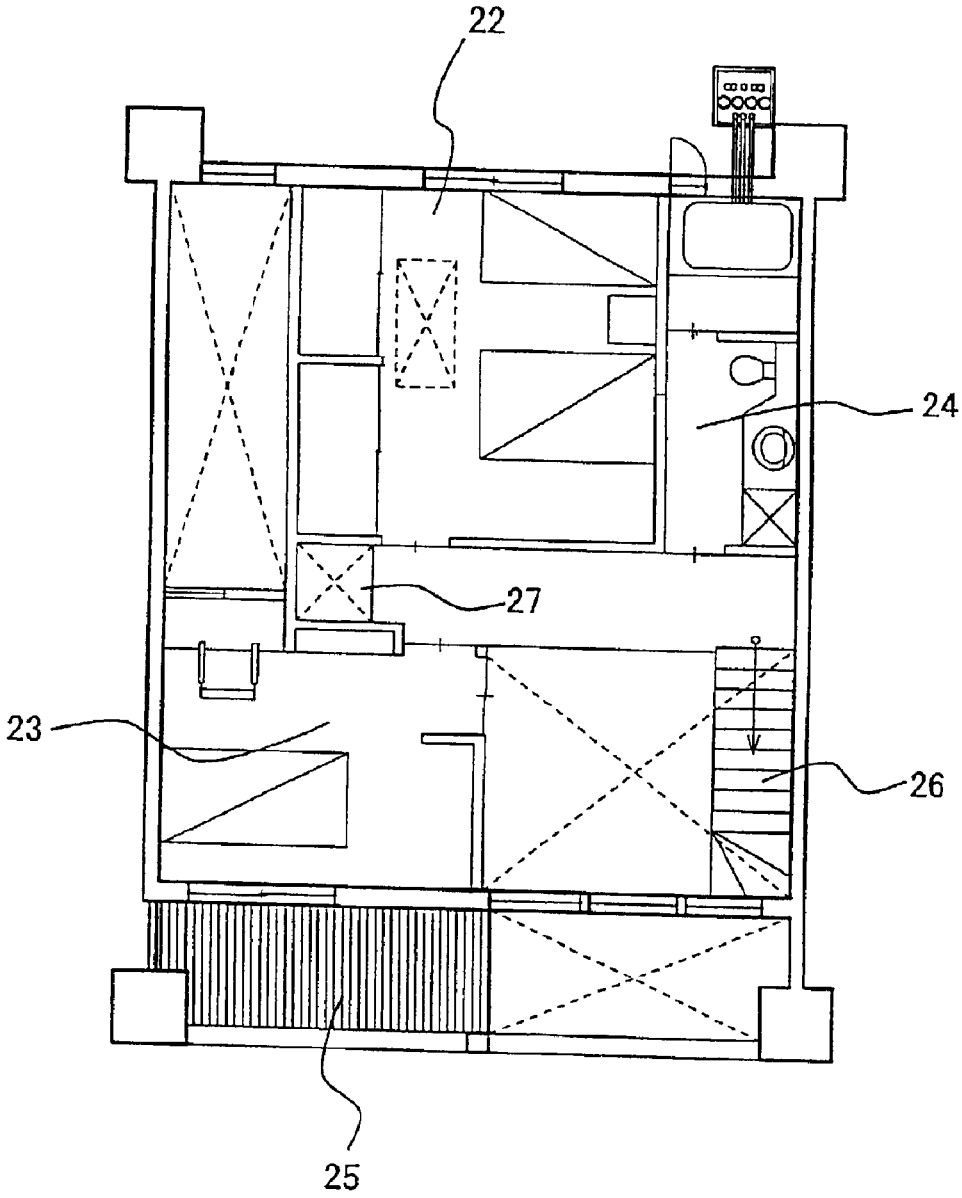
FIG. 3 is a plan view of a second-story part of the standard floor which constitutes the one example of the first embodiment of the multiple dwelling house according to the invention.

FIGS. 2 and 3 are plan views of the first and second stories of a dwelling space on each of the even-numbered floors. FIG. 2 shows a reference floor part which constitutes the first story of the dwelling space. The reference floor part includes an entrance 16 which is constructed as a doorway, an entrance hall 17, a living-dining kitchen 18, a toilet 19 and a storage space 20. Reference numeral 21 denotes a veranda.

FIG. 3 is a plan view showing an upper-story floor part which constitutes a second-story part of the dwelling space. The second-story part includes a main bedroom 22, a sub-bedroom 23, and an equipment room 24 having various kinds of equipment such as a bathroom, a washroom and a toilet. A veranda 25 can also be provided at the exterior of the second-story part.

Each of the entrance 16, the entrance hall 17 and the living-dining kitchen 18 is constructed in partly wellhole style, and a part above the toilet 19 and the storage space 20 is constructed on the upper-story floor. A user can store and draw stuff into and from the storage space 20 through a port (shown by dashed lines in FIG. 3) formed in the floor of the main bedroom 22 on the upper-story floor. The user accesses the upper-story floor by using stairs 26 formed on a side wall of the living-dining kitchen 18 or by using an elevating lift 27 having gates formed to face the entrance hall 17 and a passage on the second story, respectively.

The elevating lift 27 is mainly used by a physically handicapped or old person.

Figure 4:
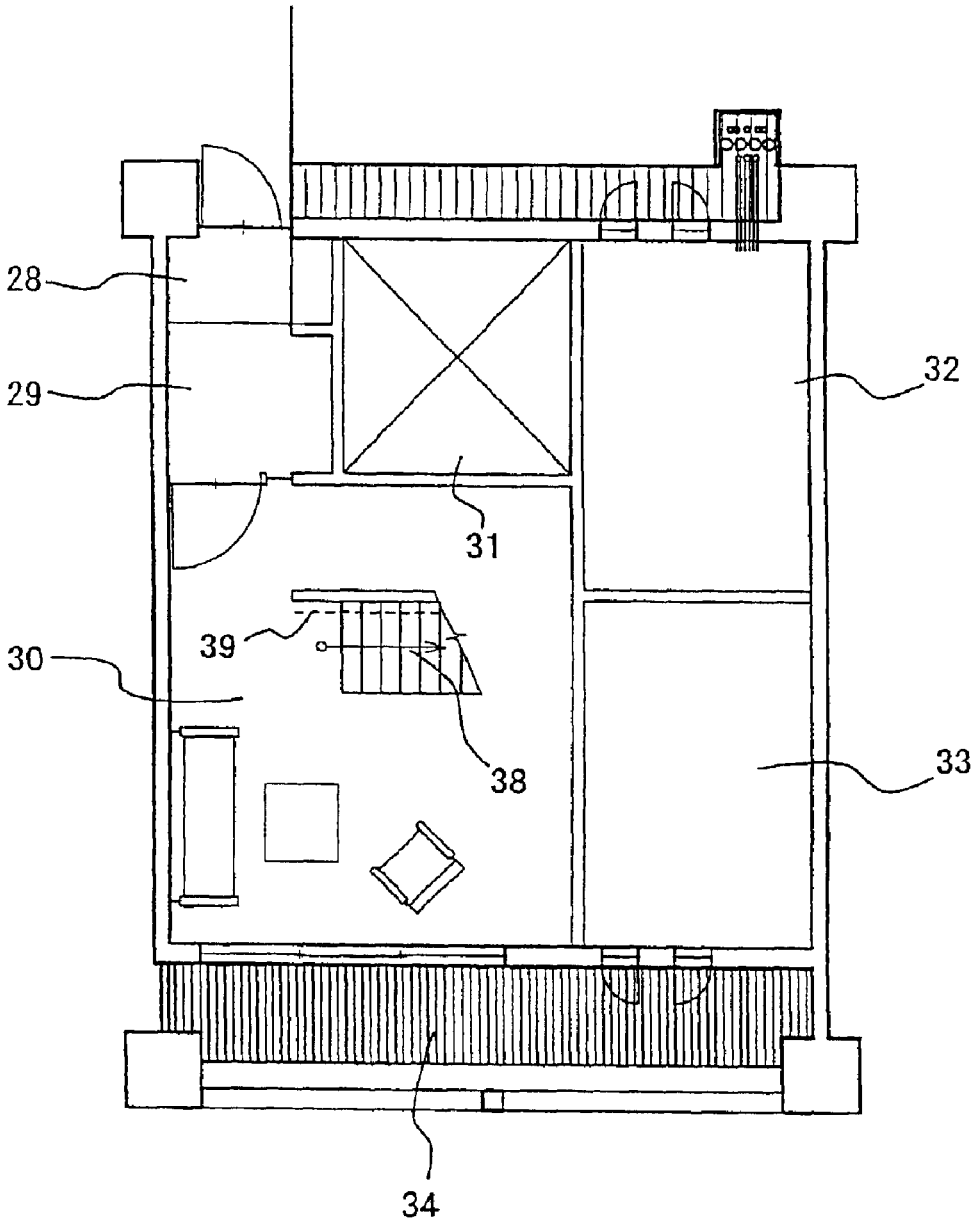
FIG. 4 is a plan view of a reference floor part of a standard floor which constitutes another example of the first embodiment of the multiple dwelling house according to the invention.
Figure 5:
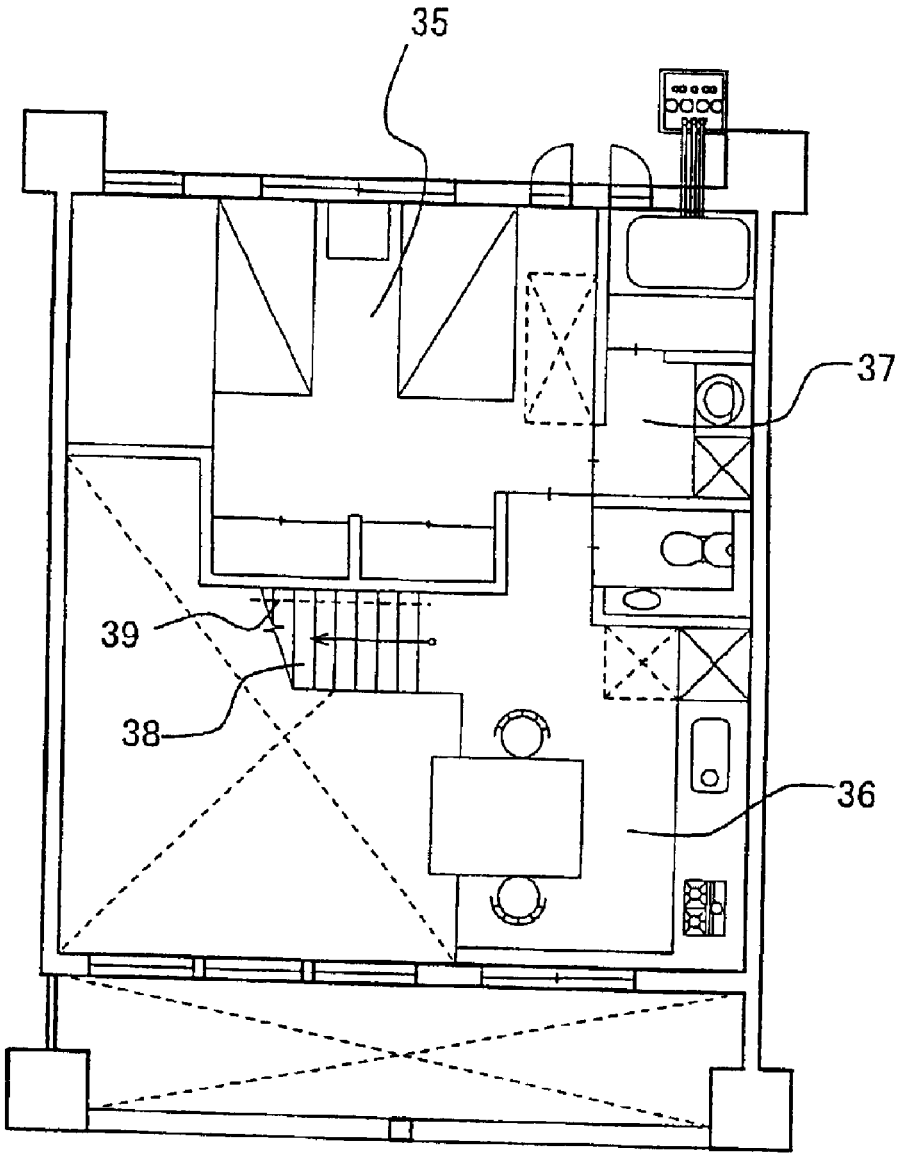
FIG. 5 is a plan view of a second-story part of the standard floor which constitutes the other example of the first embodiment of the multiple dwelling house according to the invention.

FIGS. 4 and 5 are plan views of a dwelling space on each of the odd-numbered floors. FIG. 4 shows a reference floor part of the dwelling space. The reference floor part includes an entrance 28 which is constructed as a doorway, an entrance hall 29, a living room 30, an equipment space 31, a storage space 32 and another storage space 33. Reference numeral 34 denotes a veranda.

FIG. 5 is a plan view showing an upper-story floor part of the dwelling space. The upper-story floor part includes a bedroom 35, a dining kitchen 36, and an equipment room 37 having various kinds of equipment such as a bathroom, a washroom and a toilet.

The living room 30 is constructed in partly wellhole style, and a part above the equipment space 31, the storage space 32 and the storage space 33 is constructed as the upper-story floor. A user accesses the upper-story floor by using stairs 38 formed in the-living room 30 or by using a wall-mounted elevating lift 39 formed along the side wall of the stairs 38.

The elevating lift 39 is mainly used by a physically handicapped or old person.

The cross-sectional planning of the dwelling spaces will be described below with reference to the third and four floors shown in FIG. 1 which are representative of the standard floors.

The structural floor height H between the upper beam surfaces of the third floor and those of the fourth floor and the structural floor height H between the upper beam surfaces of the fourth floor and those of the fifth floor are made the same dimension of 4,800 mm.

The floor face of the third floor is constructed by a beam slab method using T-beams, and if the beam depth dimension of each of the beams is made 800 mm, the dimension H1 between the upper surface of the floor slab 12 of the third floor and the lower surface of the floor slab 14 of the fourth floor becomes 4,000 mm. Accordingly, if the floor face which includes sleepers, floor joists, vibration isolators and a coating material for floor finish has a finished thickness dimension of 150 mm, the ceiling height of the living room 30 which has a wellhole-style structure is approximately 3,850 mm.

An official notice of the Ministry of International Trade and Industry specifies that if the ceiling height of each of the storage spaces 32 and 33 formed on the lower-story floor is made 1,400 mm or less, the storage spaces 32 and 33 should be excluded from the floor area of the dwelling unit. Accordingly, by forming the finished floor face of a floor portion corresponding to the storage spaces 32 and 33 as that of a floor of the type in which floor joists are directly secured to a floor slab, even if the floor thickness dimension of the upper-story floor is made 150 mm, the ceiling height of each of the bedroom 35 and the equipment room 37 on the upper-story floor becomes approximately 2,400 mm, whereby it is possible to ensure a sufficient ceiling height in each of the bedroom 35 and the equipment room 37.

Accordingly, it is possible to ensure sufficient ceiling heights in both the reference floor part and the second-story part which is the upper-story part, and it is also possible to ensure a sufficient storage space which is excluded from the floor area but is substantially effective.

Since the ceiling height of each of the storage spaces 32 and 33 can be set to be slightly lower than 1,400 mm, the user can store and draw stuff into and from either of the storage spaces 32 or 33 with a slight stoop. Accordingly, unlike an underground storage space formed within a beam depth by a related-art flat slab method, each of the storage spaces 32 and 33 has a sufficient height and offers an extremely great convenience in usage. In addition, since the storage spaces 32 and 33 are formed above the floor face, a ventilating part can be easily formed in a portion such as a wall of each of the storage spaces 32 and 33. Accordingly, it is possible to easily take moisture-proofing and insect-proofing countermeasures, and it is possible to solve the risk that mold or worms occur in stored stuff.

Since the floor slab surface of the fourth floor has a flat slab structure, if the thickness of the floor slab is made 150 mm and the beam depth 800 mm similarly to the case of the third floor, the slab-to-slab dimension H2 of the fourth floor becomes 5,300 mm.

Accordingly, if the finished thickness dimension of the floor face is made 150 mm, the ceiling height of the living-dining kitchen 18 which has a wellhole-style structure is approximately 5,150 mm. In addition, in the case where the ceiling height dimension of the storage space 20 on the reference floor is made 1,400 mm or less similarly to the case of the third floor, even if the floor thickness of the upper-story floor is made 150 mm, the ceiling height of each of the main bedroom 22 and the equipment room 24 on the upper-story floor becomes approximately 3,750 mm, whereby it is possible to ensure a sufficient ceiling height in each of the main bedroom 22 and the equipment room 24.

In addition, in the case where the storage space 20 is formed in two-story style and the ceiling height of each of the two stories is made approximately 1,300 mm and the floor thickness between both stories is made 150 mm, the ceiling height dimensions of the main bedroom 22 and others on the upper-story floor become approximately 2,400 mm, whereby it is possible to ensure a normal ceiling height and it is also possible to double the storage space 20.

In addition, either one of the two stories formed in the storage space 20 may be constructed as an ecological space which serves as a facility in which to dispose or store various ecological systems or ecological products.

For example, a system such as equipment for disposal and recycling of garbage, an air cleaning unit using activated carbon, a minus ion generating device or a water cleaning and recycling unit can be disposed in the ecological space, and the ecological space can also be used as a facility which stores a material for such a system.

In the dwelling unit having the flat slab side as the floor face, the floor face is lower than the beams. Accordingly, in the first embodiment, pipes for the living-dining kitchen 18 and the equipment room 24 including various kinds of equipment such as a bathroom, a washroom and a toilet are constructed in such a manner that a water supply riser and a drainage riser are formed in an exterior common space and water supply branch pipes and drainage branch pipes are inserted through a wall of the dwelling space on the upper-beam-surface side thereof and are arranged horizontally along a separation wall. Accordingly, it is possible to construct a piping system which is reduced in the number of bent portions and is arranged at a position where repair and replacement are easy.

A second embodiment of the invention will be described below.

Figure 6:
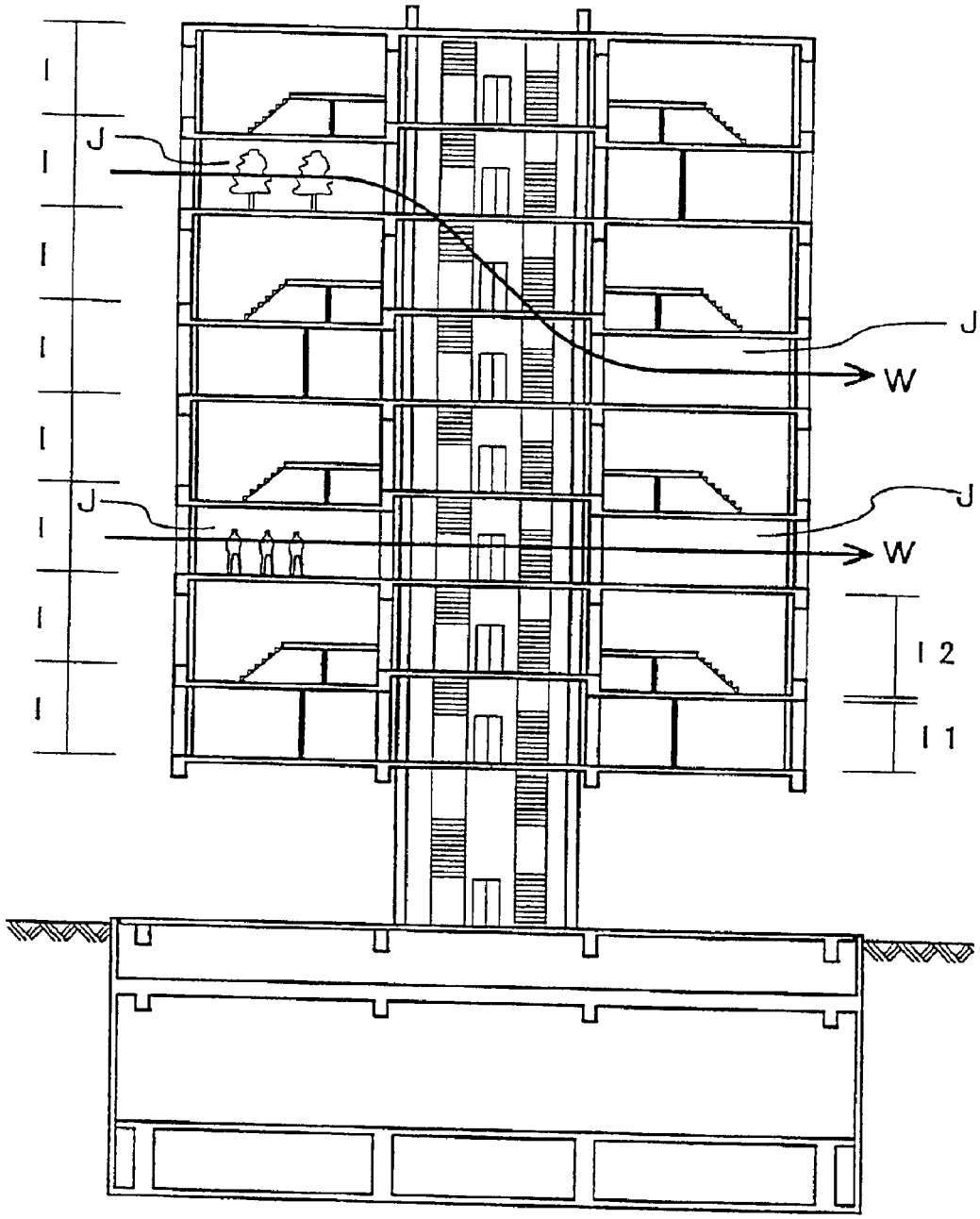
FIG. 6 is a cross-sectional view of a second embodiment of the multiple dwelling house according to the invention.

FIG. 6 is a cross-sectional view showing the cross-sectional planning of the second embodiment, and a structural floor height I between the upper beam surfaces of each of the standard floors and those of the next adjacent one is made the same floor height dimension of 3,600 mm.

The second embodiment will be described below with reference to one unit on each of the second and third floors.

Similarly to the case of the first embodiment, floor planning is performed on a pair of odd- and even-numbered floors.

The floor face of the second floor is constructed as a T-beam slab surface, and if the beam depth dimension of each of the beams is made 800 mm, a slab-to-slab dimension I1 of the second floor becomes 2,800 mm. Accordingly, even if the finished thickness dimension of the floor face is taken into account, the ceiling height of each of a living room and a dining kitchen on a reference side which is a living space becomes approximately 2,650 mm, whereby it is possible to ensure a ceiling height sufficient for an ordinary construction.

On the other hand, the floor face of the third floor has a flat slab structure. If the slab thickness of the floor is made 150 mm and the beam depth dimension is made 800 mm similarly to the case of the second floor, a slab-to-slab dimension I2 of the third floor becomes approximately 4,100 mm.

Accordingly, even if the finished thickness dimension of the floor face is taken into account, the ceiling height of each of a living room and a dining kitchen which have a wellhole-style structure becomes approximately 3,950 mm. When a two-story construction of the type which has the first and second stories shown in the respective layouts of FIGS. 4 and 5 is adopted, if the ceiling height of each of the storage spaces 32 and 33 on the lower-story floor is made 1,400 mm or less, the ceiling height of each of the bedroom 35, the dining kitchen 36 and others on the upper-story floor becomes 2,400 mm even in the case where the floor thickness of the upper-story floor is 150 mm. Therefore, it is possible to ensure a sufficient ceiling height in each of the bedroom 35, the dining kitchen 36 and others.

In the second embodiment, the structural floor height of the reference floor is made 3,600 mm which is not greatly different from the floor height dimensions of related art buildings. A plane dwelling space having a sufficient ceiling height and a dwelling space having two stories are planned as one unit. The vertical arrangement of an even-numbered floor and an odd-numbered floor in one unit is opposite to that used in the first embodiment.

A third embodiment of the invention will be described below.

As shown in the cross-sectional view of FIG. 6 referred to above, an upper floor and a lower floor, i.e., a dwelling space having two stories and a dwelling space having a sufficient ceiling height, are planned as one unit. However, the space on either one of the upper and lower floors can also be planned as a common space J.

The common space J can be constructed as an exterior space such as various kinds of gardens or athletic facilities or an interior space such as various kinds of assembly spaces or indoor athletic facilities, as required.

The common space J can also be constructed as an exclusive space for a particular resident.

Furthermore, the common space J can be constructed as a wellhole-style space through which a wind W can blow, whereby the building can be given the function of reducing wind pressure applied to itself or preventing building wind from blowing toward neighboring houses.

In addition, residents can enjoy draft, daylighting and views from various directions owing to the wellhole-style space.

A fourth embodiment of the invention will be described below.

Figure 7:
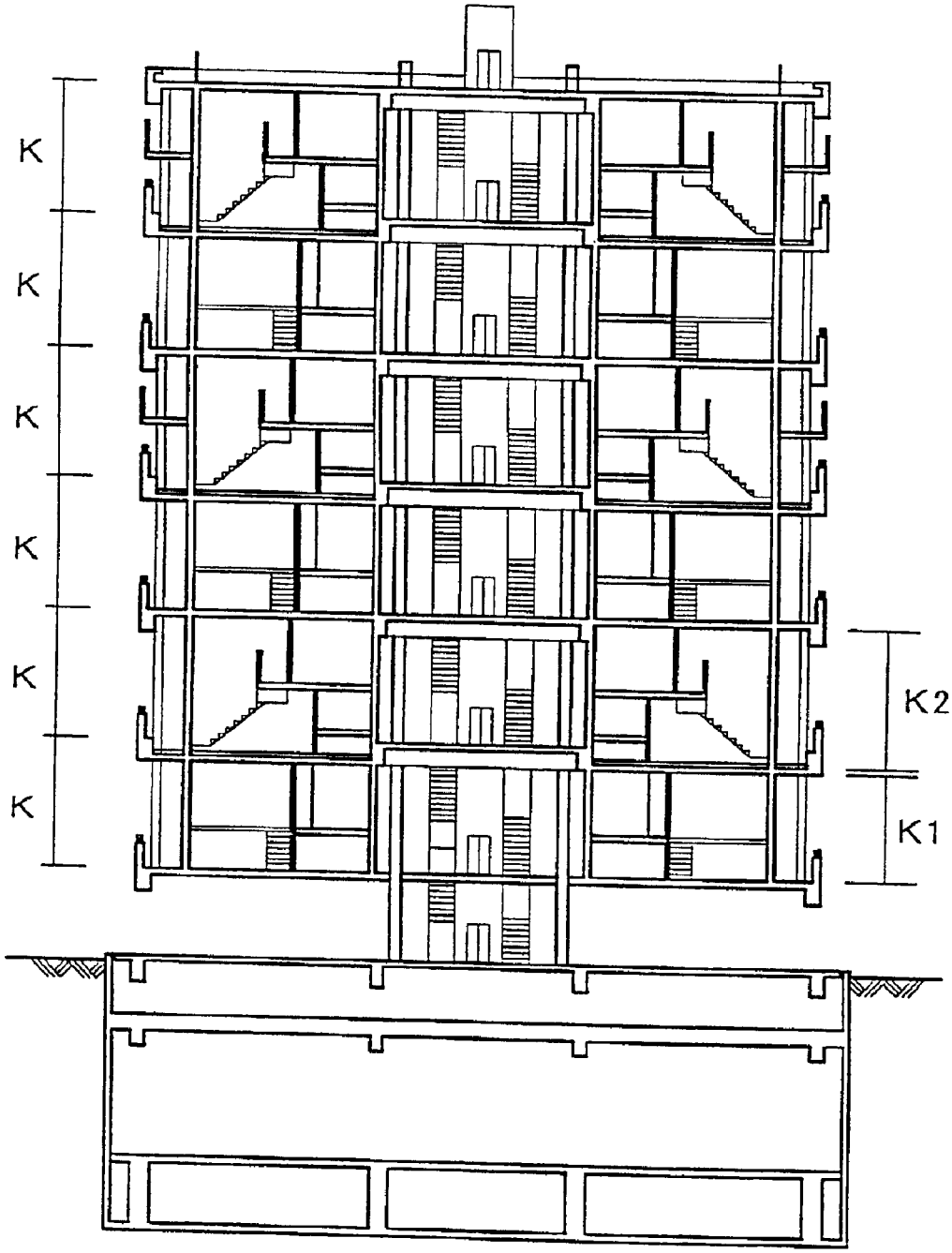
FIG. 7 is a cross-sectional view of a fourth embodiment of the multiple dwelling house according to the invention.

FIG. 7 is a cross-sectional view showing the cross-sectional planning of the fourth embodiment, and a structural floor height K between the upper beam surfaces of each of the standard floors and those of the next adjacent one is made the same floor height dimension of 6,000 mm.

The fourth embodiment will be described below with reference to one unit on each of the second and third floors.

Similarly to the case of the first to third embodiments, floor planning is performed on a pair of adjacent odd- and even-numbered floors.

The floor face of the second floor is constructed as a T-beam slab surface, and if the beam depth dimension of each of the beams is made 800 mm, a slab-to-slab dimension K1 of the second floor becomes 5,200 mm. Accordingly, even if the finished thickness dimension of the floor face is taken into account, the ceiling height of each of a living room and a dining kitchen on a reference side which is a living space becomes approximately 5,050 mm, whereby it is possible to adopt the plan views of the first and second stories of the first embodiment shown in FIGS. 2 and 3 and it is also possible to ensure a ceiling height.

On the other hand, the floor face of the third floor has a flat slab structure. If the slab thickness of the floor is made 150 mm and the beam depth dimension is made 800 mm similarly to the case of the second floor, a slab-to-slab dimension K2 of the third floor becomes approximately 6,500 mm.

Accordingly, even if the finished thickness dimension of the floor face is taken into account, the ceiling height of each of a living room and a dining kitchen which have a wellhole-style structure becomes approximately 6,350 mm. When a two-story construction of the type which has the first and second stories shown in the respective plan views of FIGS. 2 and 3 is adopted, if the ceiling height of the storage space 20 on the reference floor is made 1,400 mm or less similarly to the case of the above-described embodiment and the floor face of the storage space 20 is finished with a floor thickness of 150 mm, the ceiling height of each of the main bedroom 22, the equipment room 24 and others on the upper-story floor becomes approximately 4,800 mm even in the case where the floor thickness of the upper-story floor is 150 mm. Therefore, it is possible to ensure a sufficient ceiling height in each of the main bedroom 22, the equipment room 24 and others.

In addition, in the case where the storage space 20 is formed in two-story style and the ceiling height of each of the two stories is made approximately 1,400 mm and the floor face of the storage space 20 is finished with a floor thickness of 150 mm and the floor thickness between both stories is made 150 mm, the ceiling height dimensions of the main bedroom 22 and others on the upper-story floor become approximately 3,400 mm, whereby it is possible to ensure a sufficient ceiling height.

In addition, it goes without saying that either one of the two stories formed in the storage space 20 may be used as an ecological space.

A fifth embodiment of the invention will be described below.

In the invention, unbond PC slabs such as rib slabs and void slabs can be used as floor slabs, and binders can be omitted. However, in the case where the depth of a dwelling unit is extended and a beam needs to be formed in a living room of the dwelling unit, the beam will be formed protrusively from a floor face having a flat slab portion or a ceiling face having a beam slab portion. However, by extending the beam in the storage space shown in any of the above-described layout examples or at the boundary between the living space and the storage space or in a space below stairs leading to an upper-story floor, it is possible to extend the dwelling unit in a horizontal direction irrespective of the ceiling height of the living-room space.

A sixth embodiment of the invention will be described below.

The sixth embodiment provides a dwelling-unit space of the maisonette type in which one resident exclusively possesses one unit in which an odd-numbered floor and an even-numbered floor are vertically adjacent to each other. In the sixth embodiment, a resident can enjoy the second-story part of a reference floor as a three-dimensional space which is substantially made of three to five stores having different ceiling heights, whereby the resident can obtain a large number of storage spaces and different spaces which differ in draft, daylighting and view. Accordingly, the resident can obtain rich dwelling life.

A seventh embodiment of the invention will be described below.

Figure 8:
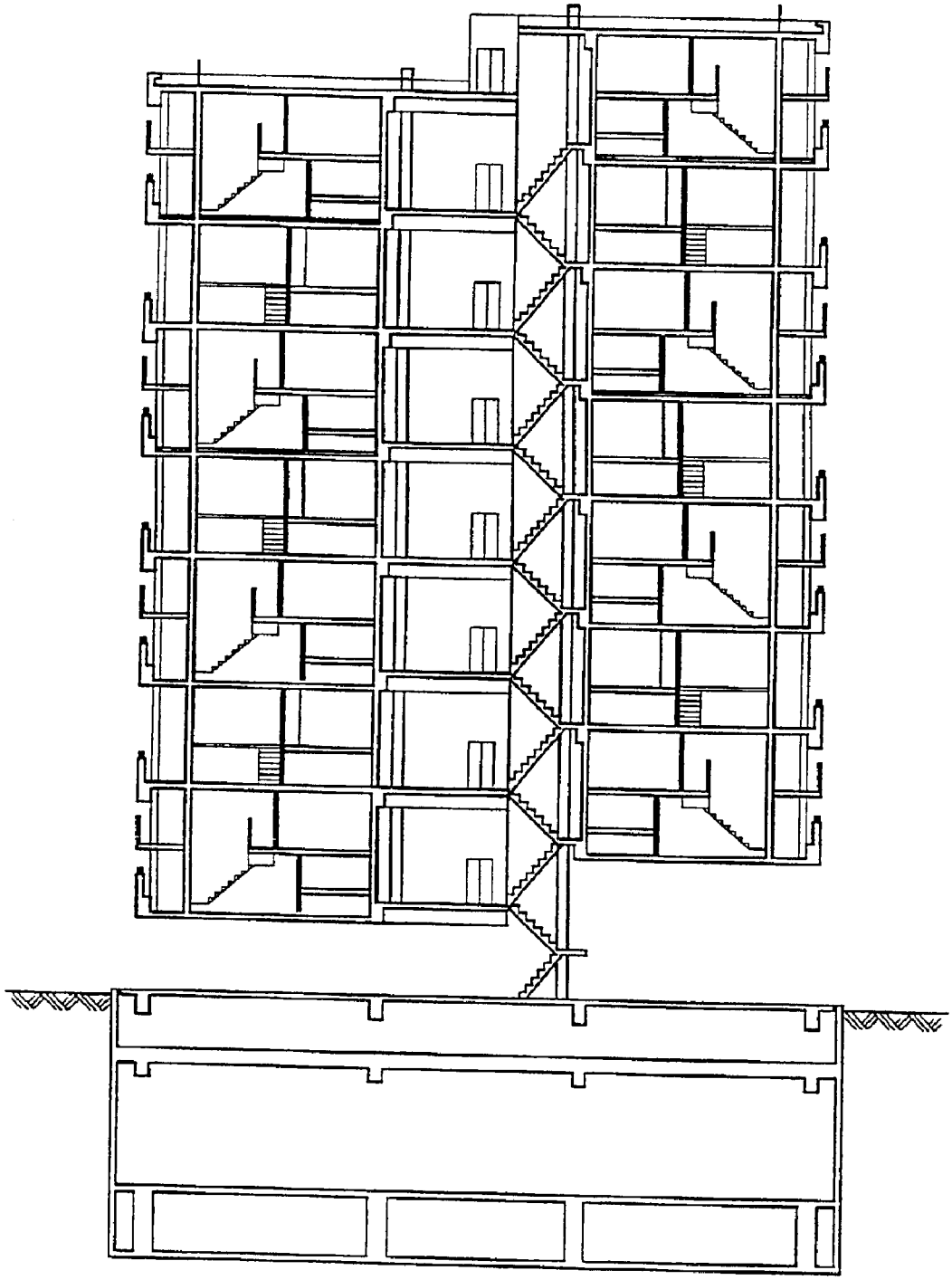
FIG. 8 is a cross-sectional view of a seventh embodiment of the multiple dwelling house according to the invention.
Figure 9:
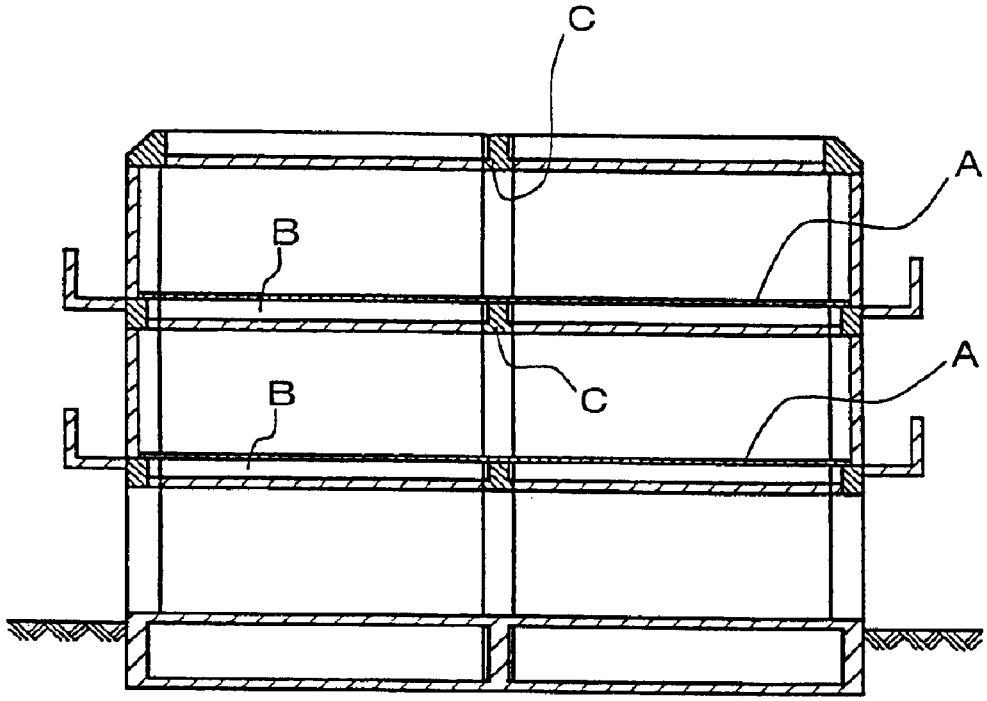
FIG. 9 (PRIOR ART)
FIG. 9 is a cross-sectional view of a related-art example of a multiple dwelling house.

The multiple dwelling house shown in FIG. 8 is constructed on the basis of the cross-sectional planning of shifting its right- and left-hand groups of floors from each other. According to this planning, the positions of the gates of individual dwelling-unit spaces is varied in the height direction of the multiple dwelling house, whereby residents can be completely prevented from coming across one another at the gates, and it is possible to reduce the possibility that the interiors of the respective dwelling units may be viewed from a common passage, thereby improving privacy to a further extent.

In addition, the multiple dwelling house has an external appearance capable of making different impressions on persons at different viewing angles.

Incidentally, although the embodiments have been described with reference to multiple dwelling houses, the invention can be applied to offices, stores or various other uses.

It goes without saying that as a structural type to be used in the depth direction (longitudinal direction), it is possible to adopt a frame construction or a wall construction as required.

In the multiple dwelling house according to the invention, three-dimensional spaces having a constant structural floor height but different ceiling heights can be formed on adjacent upper and lower floors.

Because the floor heights are constant, members having the same dimensions can be used repeatedly and efficiently, and a precast construction can also be adopted.

The invention can provide, as a dwelling space for a multiple dwelling house, a rich dwelling space which has a construction based on any of the above-described embodiments, and is made of a three-dimensional space having a large ceiling height but a reduced structural floor height.

In the invention, a space which has a flat slab and has a ceiling height of 1,400 mm or less and, therefore, is excluded from the floor area of a dwelling unit is used as a storage space, whereby it is possible to greatly increase storage spaces and provide a dwelling environment having an increased number of storage spaces.

Furthermore, in one unit which has dwelling spaces adjacently formed above and below a flat slab according to the invention, it is possible to obtain spaces which have a constant structural floor height but different slab-to-slab dimensions between adjacent upper and lower floors. Accordingly, it is possible to provide buildings which have the same external appearance but different internal spaces containing three-dimensional spaces which are rich in variation in their vertical directions. In addition, it is possible to obtain a large number of different three-dimensional spaces by varying the ceiling heights of the internal spaces.

Furthermore, it is possible to obtain far more variations of dwelling spaces by varying the structural floor height dimensions thereof.

Even in the horizontal direction, it is possible to obtain a variety of layouts by combining the above-described three-dimensional spaces.

Accordingly, it is possible to obtain dwelling spaces which match a variety of needs of users.

In addition, any of the above-described dwelling units, preferably a space having a smaller ceiling height in any of the dwelling units, can be used as a common interior space such as a garden space, an athletic space or an assembly space which is to be prepared as an exterior space. Furthermore, such a space can also be constructed as a space through which winds can blow, whereby a building can be given the function of reducing wind pressure applied to itself or preventing building wind from blowing toward neighboring houses.

According to this construction, such space can also be constructed as an exclusive space for a resident or as a common space.

What is claimed is:

1. A multiple dwelling house comprising:

an internal support structure defining a plurality of standard floors disposed vertically one above the other in which dwelling units are formed, said support structure comprising a plurality of flat slab structures and beam slab structures which each separate an adjacent upper one of said standard floors from an adjacent lower one of said standard floors, said flat slab structures and said beam slab structures being defined by respective floor slabs and associated beams which support said floor slabs, said floor slabs having opposite upper and lower faces, and each said flat slab structure having said beams thereof projecting upwardly from said upper surface of said associated floor slab and each said beam slab structure having said beams thereof projecting downwardly from said lower surface of said associated floor slab, said beam slab structures and said flat slab structures being arranged in a sequentially repeated manner wherein each said flat slab structure is disposed vertically spaced from an adjacent said beam slab structure to define one said standard floor therebetween, each said standard floor having a ceiling face and opposing floor face which defines a ceiling height, said ceiling height of one said standard floor being different from said ceiling height of a vertically adjacent one of said standard floors as a result of said sequentially repeated manner of said flat slab structures and said beam slab structures, while said standard floors have the same structural floor height dimension defined vertically between upper surfaces of said beams of each said standard floor and the upper surfaces of said beams of a vertically adjacent one of said standard floors.

2. A multiple dwelling house according to claim 1, wherein each said beam slab structure forms the ceiling face of the standard floor disposed therebelow and the floor face of the standard floor disposed thereabove.

3. A multiple dwelling house according to claim 1, wherein the upper surface of said beams of said beam slab structure are disposed flush with said upper surface of said floor slab associated therewith.

4. A multiple dwelling house according to claim 2, wherein each said beam has a lower surface wherein said lower surfaces of said beams of said flat slab structure are disposed flush with said lower faces of said floor slabs associated therewith.

5. A multiple dwelling house according to claim 4, wherein the upper surfaces of said beams of said beam slab structures are disposed flush with said upper faces of said floor slabs associated therewith.

6. A multiple dwelling house according to claim 5, wherein one said standard floor is defined between said flat slab structure located at said ceiling of said one standard floor and said beam slab structure located at said floor thereof such that said ceiling face and said floor face of said one standard floor are free of any said beams projecting into said dwelling space.

7. A multiple dwelling house according to claim 6, wherein one said standard floor is defined by said beam slab structure at a ceiling thereof and said flat slab structure at a floor thereof such that said one standard floor has said beams of said beam slab structure and said floor slab structure projecting vertically into said dwelling unit thereof.

8. A multiple dwelling house comprising:

a plurality of standard floors disposed one above the other which define dwelling units on a plurality of said standard floors, each said standard floor having a ceiling face and an opposing floor face which defines a ceiling height thereof, said standard floors being separated vertically one from the other by horizontally enlarged floor structures wherein every other floor structure is formed as a flat slab structure while each vertically successive floor structure is formed as a beam slab structure, each said flat slab structure comprising a respective floor slab and associated beams which support said floor slab and project upwardly from said floor slab, and each said beam slab structure comprising a respective floor slab and beams associated therewith which support said floor slab and project downwardly below a lower surface of the floor slab, each of said standard floors having the same structural floor height dimension defined vertically between upper surfaces of said beams of each said standard floor and the upper surfaces of said beams of the vertically adjacent one of said standard floors, wherein said ceiling height of each said standard floor differs from said ceiling height of said standard floors disposed vertically adjacent thereto, said multiple dwelling house further including interior floor structure disposed within at least one of said standard floors which subdivides said one standard floor into a plurality of stories.

9. A multiple dwelling house according to claim 8, wherein every other one of said standard floors is free of said beams projecting from said floor slab structures into said dwelling space thereof.

10. A multiple dwelling house according to claim 8, wherein said stories of one said standard floor define a wellhole style space.

11. A multiple dwelling house according to claim 8, each of said stories has a vertical height which differs one from the other.

* * * * *